US007410939B2

(12) United States Patent
Noerenberg et al.

(10) Patent No.: US 7,410,939 B2
(45) Date of Patent: Aug. 12, 2008

(54) CLEANING AGENT COMPOSITION COMPRISING POLYMERS CONTAINING NITROGEN

(75) Inventors: Ralf Noerenberg, Buettelborn (DE); Helmut Meffert, Ludwigshafen (DE); Karl Haeberle, Speyer (DE); Martin Scholtissek, Mannheim (DE); Cordula Mock-Knoblauch, Ludwigshafen (DE); Franz Weingart, Weinheim (DE)

(73) Assignee: BASF Aktiengesellschaft, Ludwigshafen (DE)

( * ) Notice: Subject to any disclaimer, the term of this patent is extended or adjusted under 35 U.S.C. 154(b) by 340 days.

(21) Appl. No.: 10/496,784

(22) PCT Filed: Dec. 11, 2002

(86) PCT No.: PCT/EP02/14062

§ 371 (c)(1),
(2), (4) Date: Jun. 4, 2004

(87) PCT Pub. No.: WO03/050219

PCT Pub. Date: Jun. 19, 2003

(65) Prior Publication Data

US 2005/0032667 A1 Feb. 10, 2005

(30) Foreign Application Priority Data

Dec. 12, 2001 (DE) ..... 101 60 993

(51) Int. Cl.
*C11D 1/00* (2006.01)
*C11D 3/06* (2006.01)
*C11D 3/08* (2006.01)
*C11D 3/26* (2006.01)
*C11D 3/37* (2006.01)

(52) U.S. Cl. ..... 510/435; 510/235; 510/238; 510/500; 510/501; 510/505

(58) Field of Classification Search ..... None
See application file for complete search history.

(56) References Cited

U.S. PATENT DOCUMENTS

| | | | |
|---|---|---|---|
| 4,676,921 | A | 6/1987 | Vander Meer |
| 5,863,879 | A | 1/1999 | Guenther et al. |
| 6,300,306 | B1 | 10/2001 | Firkins et al. |

FOREIGN PATENT DOCUMENTS

| | | | |
|---|---|---|---|
| DE | 100 29 026 | | 12/2001 |
| DE | 100 29 027 | | 12/2001 |
| DE | 101 15 255 | | 10/2002 |
| WO | WO 98/13449 | | 4/1998 |
| WO | WO 00/02989 | | 1/2000 |
| WO | WO 00/27958 | | 5/2000 |
| WO | WO01/46374 | * | 6/2001 |

* cited by examiner

*Primary Examiner*—Gregory R Del Cotto
(74) *Attorney, Agent, or Firm*—Oblon, Spivak, McClelland, Maier & Neustadt, P.C.

(57) ABSTRACT

A cleaner composition which comprises at least one surfactant, at least one builder and at least one nitrogen-containing polymer is described. The nitrogen-containing polymer is, for example, an alkoxylated polyvinylamine, an alkoxylated, acylated or alkylated polyaminoamide or a polyurethane-urea with tertiary amino groups. The nitrogen-containing polymers facilitate soil release.

12 Claims, No Drawings

CLEANING AGENT COMPOSITION COMPRISING POLYMERS CONTAINING NITROGEN

The present invention relates to a cleaner composition which comprises at least one surfactant, at least one builder and at least one nitrogen-containing polymer, and to methods for cleaning hard surfaces.

Objects made of synthetic materials, such as thermosetting or thermoplastic polymers, for example plastic dishes, usually have hydrophobic surface properties. Hydrophobic soiling, such as carotenoids, is stubbornly adsorbed on the surface of these objects and can only be removed incompletely using surfactant-containing cleaners. In addition, the film of water should run off during rinsing without after-polishing and not leave behind any undesired traces, for example as a result of water hardness. The known cleaners are still in need of improvement in this regard.

There is therefore a need for cleaners and pre-treatment agents which temporarily or permanently change the surface of objects made of hydrophobic materials such that the adhesion of soiling is reduced and cleaning is facilitated.

The unpublished German patent application P 100 29 027.2 describes the use of alkoxylated polyvinylamines, the unpublished German patent application P 101 15 256.6 describes the use of polyaminoamides, the unpublished German patent application P 100 29 026.4 and P 101 15 255.8 the use of cationic polymers which have urethane and/or urea groups, for increasing the surface hydrophilicity of hydrophobic materials.

The invention provides a cleaner preparation which comprises

A) at least one surfactant,

B) at least one builder and

C) at least one nitrogen-containing polymer with repeat units of the formula I, II or III,

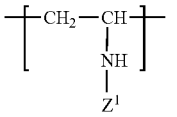

(I)

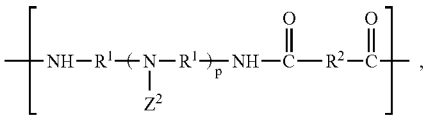

(II)

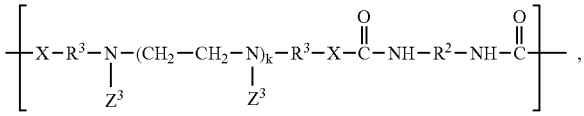

(III)

in which $R^1$ is $C_2$-$C_8$-alkanediyl, $R^2$ is a chemical bond or $C_1$-$C_{20}$-alkanediyl which is optionally interrupted by a double bond and/or an imino group and/or is optionally, completely or partially, a constituent of one or more saturated or unsaturated carbocyclic 5- to 8-membered rings, where the alkanediyl may carry one or more hydroxyl groups and/or amino groups, $R^3$ is $C_2$-$C_8$-alkanediyl or is $$—CH_2—CHR^4—(O—CH_2—CHR^4)_q—$$

X is O, NH or $C_1$-$C_6$-alkylamino, $Z^1$ is hydrogen or is $$—(CH_2—CHR^4—O)_q—H$$

where at least one part of the radical $Z^1$ is different from hydrogen, $Z^2$ is hydrogen, $R^5CO$, $R^6$- or $$—(CH_2 CHR^4—O)_q—H$$

where at least one part of the radicals $Z^2$ is different from hydrogen, $Z^3$ is $C_1$-$C_6$-alkyl, phenyl or phenyl-$C_1$-$C_4$-alkyl or, if k=0, together with N—$R^3$—X can form a 5- to 7-membered saturated heterocyclic ring having 2 nitrogen atoms or, if k=1, the two radicals $Z^3$ can together with N—$CH_2$—$CH_2$—N form a 5- to 7-membered saturated heterocyclic ring having 2 nitrogen atoms, $R^4$ is hydrogen or $C_1$-$C_{10}$-alkyl, $R^5$ is $C_4$-$C_{27}$-alkyl or $C_4$-$C_{27}$-alkenyl, where the alkyl or alkenyl groups may carry one or more substituents which are chosen from hydroxyl, alkoxy, alkoxycarbonyl or $NE_1E_2$ in which $E_1$ and $E_2$ may be identical or different and are hydrogen, alkyl or acyl;

$R^6$ is $C_4$-$C_{27}$-alkyl or $C_4$-$C_{27}$-alkenyl, where the alkyl or alkenyl groups may carry one or more substituents which are chosen from hydroxyl, alkoxy, alkoxycarbonyl or $NE_1E_2$, in which $E_1$ and $E_2$ may be identical or different and are hydrogen, alkyl or acyl;

p is a number from 1 to 20, q is a number from 1 to 20, k is 0 or 1;

or reaction products thereof with neutralizing agents or quaternizing agents.

The cleaner composition according to the invention generally comprises (A) 0.5 to 40% by weight, preferably 5 to 30% by weight, in particular 10 to 25% by weight, of surfactant, (B) 1 to 60% by weight, preferably 1 to 40% by weight, in particular 2 to 15% by weight, of builder, (C) 0.01 to 50% by weight, preferably 0.1 to 25% by weight, in particular 0.5 to 5% by weight of nitrogen-containing polymer, based on the total weight of the cleaner composition.

Nitrogen-containing polymers with repeat units of the formula I are derived from alkoxylated polyvinylamines.

Polyvinylamines are to be understood as meaning polymers constructed partially or completely from repeat units derived formally from N-vinylamine. These polymers are obtainable by (co)polymerizing open-chain N-vinylcarboxamides alone or together with other monoethylenically unsaturated comonomers, and then cleaving off from the copolymerized open-chain N-vinylcarboxamide units the formyl or alkylcarbonyl group by the action of acids, bases or enzymes to form vinylamine units. Polyvinylamines are known, cf., for example, U.S. Pat. No. 4,217,214, EP-A-0 071 050 and EP-A-0 216 387.

Examples of open-chain N-vinylcarboxamides are: N-vinylformamide, N-vinylacetamide and N-vinylpropionamide. To prepare the polyvinylamines, said monomers can either be polymerized alone, in a mixture with one another or together with other monoethylenically unsaturated monomers.

Suitable comonomers are monoethylenically unsaturated monomers, in particular vinyl esters of saturated carboxylic acids having 1 to 6 carbon atoms, such as vinyl formate, vinyl acetate, vinyl propionate and vinyl butyrate; ethylenically unsaturated $C_3$- to $C_6$-carboxylic acids, for example acrylic acid, methacrylic acid, maleic acid, crotonic acid, itaconic acid and vinylacetic acid, and alkali metal and alkaline earth metal salts thereof, esters, amides and nitriles, for example methyl acrylate, methyl methacrylate, ethyl acrylate and ethyl methacrylate; esters of ethylenically unsaturated carboxylic acids with amino alcohols, such as dimethylaminoethyl acrylate, dimethylaminoethyl methacrylate, diethylaminoethyl acrylate, diethylaminomethyl methacrylate, dimethylaminopropyl acrylate, dimethylaminopropyl methacrylate, diethylaminopropyl acrylate, dimethylaminobutyl acrylate and diethylaminobutyl acrylate, the amides of ethylenically unsaturated carboxylic acids, such as acrylamide, methacrylamide, N-methylacrylamide, N,N-dimethylacrylamide, N-methylmethacrylamide, N-ethylacrylamide, N-propylacrylamide and tert-butylacrylamide, and basic (meth) acrylamides, such as, for example, dimethylaminoethylacrylamide, dimethylaminoethylmethacrylamide, diethylaminoethylacrylamide, diethylaminoethylmethacrylamide, dimethylaminopropylacrylamide, diethylaminopropylacrylamide, dimethylaminopropylmethacrylamide and diethylaminopropylmethacrylamide.

Further suitable comonomers are: N-vinylpyrrolidone, N-vinylcaprolactam, acrylonitrile, methacrylonitrile, N-vinylimidazole, and substituted N-vinylimidazoles, such as N-vinyl-2-methylimidazole, N-vinyl-4-methylimidazole, N-vinyl-5-methylimidazole, N-vinyl-2-ethylimidazole, and N-vinylimidazolines, such as, for example, vinylimidazoline, N-vinyl-2-methylimidazoline and N-vinyl-2-ethylimidazoline. As well as being used in the form of the free bases, N-vinylimidazoles and N-vinylimidazolines are also used in a form quaternized or neutralized with mineral acids or organic acids, where the quaternization is preferably undertaken with dimethyl sulfate, diethyl sulfate, methyl chloride or benzyl chloride.

Further suitable comonomers are monomers containing sulfo groups such as, for example, vinylsulfonic acid, allylsulfonic acid, methallylsulfonic acid, styrenesulfonic acid, the alkali metal or ammonium salts of these acids or 3-sulfopropyl acrylate.

The polyvinylamine is preferably derived from homopolymers of N-vinylformamide or from copolymers which, apart from containing N-vinylformamide, also contain vinyl formate, vinyl acetate, vinyl propionate, acrylonitrile and/or N-vinylpyrrolidone in copolymerized form.

The homopolymers of the monomers and their copolymers with the monomers may be hydrolyzed to 0.1 to 100 mol %, preferably 10 to 100 mol %, in particular 50 to 99 mol %. The degree of hydrolysis of the polymers is synonymous with the content in the polyvinylamines of vinylamine units, based on the vinylamide units used.

The alkoxylated polyvinylamines are preferably derived from polyvinylamines with a K value in the range from 10 to 200, preferably 20 to 100. The K values are determined in accordance with H. Fikentscher in 5% strength aqueous sodium chloride solution at pH 7, a temperature of 25° C. and a polymer concentration of 0.5% by weight, cf. Cellulose-Chemie, volume 13, pp. 58-64 and 71-74 (1932).

The alkoxylated polyvinylamines are prepared by reacting the polyamines described above with an epoxide of the formula IV, in which $R^4$ is hydrogen or $C_1$-$C_{10}$-alkyl.

(IV)

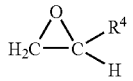

Examples of preferred epoxides of the formula IV are the epoxides of ethylene, propene, 1-butene. Here, side chains of the formula $Z^1$ form on all or some of the amino groups of the polyvinylamine. The average value $\bar{q}$ of q is determined by the molar amount of epoxide, based on the amine nitrogen atoms within the polyvinylamine which are available. In preferred embodiments, $\bar{q}$ is in the range from 1 to 15, in particular 1 to 10, particularly preferably 1 to 6.

To obtain alkoxylated polyvinylamines in which the average value $\bar{q}$ is 1, the polyvinylamines are usually reacted with an epoxide in the absence of a catalyst. Here, an aqueous solution of the polyvinylamine is expediently used. To obtain alkoxylated polyvinylamines in which $\bar{q}$ is greater than 1, the polyvinylamine is reacted with the epoxide in an anhydrous solvent. The reaction is then preferably carried out in the presence of a base. Examples of suitable bases are alkali metal carbonates, such as sodium carbonate or potassium carbonate, alkali metal and alkaline earth metal hydroxides, such as sodium hydroxide, potassium hydroxide and calcium hydroxide, alkali metal alkoxides, such as sodium methoxide and sodium ethoxide, and also sodium hydride and calcium hydride. Preferred bases are the alkali metal hydroxides and, in particular, sodium hydroxide.

Suitable solvents are $C_1$-$C_4$-alkanols, such as methanol, ethanol, n-propanol, isopropanol, n-butanol, sec-butanol, tert-butanol, ethers, such as tetrahydrofuran, dioxane, amides, such as dimethylformamide and mixtures thereof. It is also possible to use aliphatic or aromatic hydrocarbons, such as hexane, cyclohexane, toluene, xylenes, and similar solvents.

The reaction temperature is usually more than 70° C. and is preferably 70 to 150° C., in particular 75 to 110° C. The reaction can be carried out in the reactors customary for this purpose. The application of increased pressure is, in principle, not necessary. However, it may be advantageous if the components in the reaction are volatile. The reaction pressure can then be up to 50 bar, preferably up to 10 bar. The epoxide can be added in one portion or over a period which may be a few minutes to several hours.

To work up the alkoxylated polyvinylamine obtained in the reaction with the epoxide, the organic solvent is generally removed and replaced by water. This gives aqueous solutions of the desired alkoxylated polyvinylamines, which can be used directly in the cleaner preparation according to the invention. It is of course also possible to isolate the alkoxylated polyvinylamines as solid by removing the volatile constituents from the reaction.

The alkoxylated polyvinylamines according to the invention have, depending on their degree of alkoxylation, molar masses $M_w$ (determined in accordance with the light-scattering method) of from 1000 to 10 000 000, preferably from 10 000 to 2 000 000. The K values of the alkoxylated polyvinylamines according to the invention are in the range from 20 to 300, preferably in the range from 30 to 200. The K values were determined in accordance with H. Fikentscher in 5% strength by weight aqueous sodium chloride solution at pH 7 and a temperature of 25° C., and a polymer concentration of 0.5% by weight (compare above).

Nitrogen-containing polymers with repeat units of the formula II are derived from modified polyaminoamides.

Polyaminoamides are polymers whose backbone chain contains both amine and amide functionalities. They are obtainable by reacting polyalkylenepolyamines with dicarboxylic acids, preferably in a molar ratio of 1:0.5 to 1:2.

Polyalkylenepolyamines are to be understood as meaning compounds which consist of a saturated hydrocarbon chain with terminal amino functions which is interrupted by at least one secondary amino group. Suitable polyalkylenepolyamines include diethylenetriamine, triethylenetetramine, tetraethylenpentamine, pentaethylenehexamine, diaminopropylethylenediamine (=N,N'-bis(3-aminopropyl)-1,2-diaminoethane), ethylenepropylenetriamine, 3-(2-aminoethyl) aminopropylamine, dipropylenetriamine, and polyethyleneimines with molar masses of, preferably, 300 to 20 000, in particular from 300 to 5 000. Preference is given to poly-$C_2$-$C_3$-alkyleneamines with 3 to 10 nitrogen atoms. Of these, particular preference is given to diethylenetriamine, 3-(2-aminoethyl)aminopropylamine, dipropylenetriamine and diaminopropylethylenediamine. The polyalkylenepolyamines can of course be used in a mixture with one another.

Suitable dicarboxylic acids are, in particular, those with 2 to carbon atoms, such as oxalic acid, malonic acid, succinic acid, tartaric acid, maleic acid, itaconic acid, glutaric acid, adipic acid, suberic acid, sebacic acid, phthalic acid and terephthalic acid. Also suitable are dibasic amino acids, such as iminodiacetic acid, aspartic acid and glutamic acid. Preferred acids are adipic acid, glutaric acid, aspartic acid and iminodiacetic acid. The dicarboxylic acids can of course be used in a mixture with one another.

The dicarboxylic acids can be used in the form of the free acids or as carboxylic acid derivatives, such as anhydrides, esters, amides or acid halides, in particular chlorides. Examples of such derivatives are anhydrides, such as maleic anhydride, succinic anhydride, phthalic anhydride and itaconic anhydride; adipic dichloride; esters with, preferably, $C_1$-$C_2$-alcohols, such as dimethyl adipate, diethyl adipate, dimethyl tartrate and dimethyl iminodiacetate; amides, such as adipic acid diamide, adipic acid monoamide and glutaric acid diamide. Preference is given to using the free carboxylic acids or the carboxylic anhydrides.

The polycondensation of the polyamine and of the dicarboxylic acid usually takes place by heating the polyamine and the dicarboxylic acid, e.g. to temperatures of from 100 to 250° C., preferably 120 to 200° C., and distilling off the water of reaction which forms in the condensation. If said carboxylic acid derivatives are used, the condensation can also be carried out at temperatures lower than those given. The preparation of the polyaminoamides can be carried out without the addition of a catalyst, or else with the use of an acidic or basic catalyst. Suitable acidic catalysts are, for example, acids, such as Lewis acids, e.g. sulfuric acid, p-toluenesulfonic acid, phosphorous acid, hypophosphorous acid, phosphoric acid, methanesulfonic acid, boric acid, aluminum chloride, boron trifluoride, tetraethyl orthotitanate, tin dioxide, tin butyldilaurate or mixtures thereof. Suitable basic catalysts are, for example, alkoxides, such as sodium methoxide or sodium ethoxide, alkali metal hydroxides, such as potassium hydroxide, sodium hydroxide or lithium hydroxide, alkaline earth metal oxides, such as magnesium oxide or calcium oxide, alkali metal and alkaline earth metal carbonates, such as sodium, potassium and calcium carbonate, phosphates, such as potassium phosphate and complex metal hydrides, such as sodium borohydride. Where used, the catalyst is generally used in an amount of from 0.05 to 10% by weight, preferably 0.5 to 1% by weight, based on the total amount of the starting materials.

The reaction can be carried out in a suitable solvent or preferably in the absence of a solvent. If a solvent is used, suitable examples are hydrocarbons, such as toluene or xylene, nitriles, such as acetonitrile, amides, such as N,N-dimethylformamide, N,N-dimethylacetamide, N-methylpyrrolidone, ethers, such as diethylene glycol dimethyl ether, ethylene glycol dimethyl ether, ethylene carbonate, propylene carbonate and the like. The solvent is generally distilled off during the reaction or when the reaction is complete. This distillation can optionally be carried out under a protective gas, such as nitrogen or argon.

Polyaminoamides with side chains of the formula $Z^2$, in which $Z^2$ is $$-(CH_2—CHR^4—O)_q—H,$$

are obtainable by reacting the polyaminoamides with epoxides of the formula IV. In this reaction, alkoxylated side chains form on all or some of the amino groups of the polyaminoamides. The average value $\bar{q}$ of q is determined according to the molar amount of epoxide, based on the amine nitrogen atoms within the polyaminoamide which are available.

Suitable epoxides are, for example, the epoxides of ethene, propene, 1-butene, 1-pentene. With regard to the alkoxylation, reference is made to that stated previously with regard to the alkoxylation of polyvinylamines. In preferred embodiments, $\bar{q}$ is in the range from 1 to 15, in particular 1 to 10, particularly preferably 1 to 6.

Preferably about 5 to 100%, in particular 15 to 90%, of the aminonitrogen atoms within the polyaminoamide are alkoxylated.

Polyaminoamides in which $Z^2$ is $R^5CO$ are obtainable by reacting polyaminoamides with a compound of the formula $R^5$—CO—X, in which $R^5$ has the meaning already given. X is a nucleophilically displaceable leaving group, such as, in particular, hydroxyl, alkoxy, acyloxy or halogen, in particular chlorine. The compound of the formula $R^5$—CO—X is, accordingly, a carboxylic acid of the formula $R^5$—COOH or an ester, in particular an anhydride or a halide, in particular a chloride, thereof.

The amidation can be carried out under customary conditions without the addition of a catalyst or using an acidic or basic catalyst. Suitable catalysts are those which have been mentioned above with regard to the preparation of the parent polyaminoamides. The reaction can be carried out in a suitable solvent or preferably in the absence of a solvent. Suitable solvents and reaction conditions are those mentioned above in relation to the preparation of the parent polyaminoamides.

Preferably about 5 to 100%, in particular 15 to 90%, of the aminonitrogen atoms within the polyaminoamide are acylated.

Instead of reacting the polyaminoamide shown above with the carboxylic acid $R^5COOH$ or a derivative thereof, this may alternatively be added as early as during the preparation of the polyaminoamide. Polyaminoamides with side chains of the formula $Z^2$, in which $Z^2$ is $R^5CO$, which can be used according to the invention are, accordingly, obtainable by polycondensation of a polyamine with a dicarboxylic acid and a monocarboxylic acid of the formula $R^5COOH$. The dicarboxylic acid or the monocarboxylic acid of the formula $R^5COOH$ can be used as they are or in the form of a derivative, such as an anhydride, ester or halide. Preference is given to reacting the polyalkylenepolyamine, the dicarboxylic acid and the monocarboxylic acid in a molar ratio of 1:(0.5-1.5):(0.05-3).

A further alternative involves, prior to the preparation of the polyaminoamide, amidating the polyamine partially with a monocarboxylic acid of the formula $R^5COOH$ or a derivative thereof, and then reacting the product with a dicarboxylic acid or a derivative thereof to give a polyaminoamide with side chains of the formula $Z^2$, in which $Z^2$ is $R^5CO$, which can be used according to the invention.

Polyaminoamides with side chains of the formula $Z^2$, in which $Z^2$ is $R^6$, are obtainable by reacting a polyaminoamide with an alkylating agent of the formula $R^6$—Y, in which $R^6$ has the meaning already given and Y is a nucleophilically displaceable leaving group, such as halogen, in particular chlorine, bromine or iodine, or an activated hydroxyl group, such as tosyloxy.

Suitable polyaminoamides are also obtained if polyaminoamides in which some of the amine-nitrogen atoms carry side chains where $Z^2$ is equal to $R^5CO$ and/or $R^6$, are reacted as described with ethylene oxide, propylene oxide, butylene oxide or longer-chain alkyl epoxides.

If the modified polyaminoamide contains protonizable or quaternizable nitrogen atoms, these can be reacted with protonating or quaternizing agents, as is described below.

Nitrogen-containing polymers with repeat units of the formula III are urethane and/or urea groups, and polymers containing tertiary amino groups.

They are obtainable by reacting (i) at least one difunctional isocyanate and (ii) at least one compound with groups reactive toward isocyanate groups, and additionally at least one tertiary amino group.

Component (i) is preferably chosen from diisocyanates, isocyanate prepolymers with 2 isocyanate groups and mixtures thereof. Also suitable are compounds which, instead of free isocyanate groups, have functional groups which release isocyanate groups or react like isocyanate groups. These include, for example, compounds which have capped isocyanate groups, uretdione groups, isocyanurate groups and/or biuret groups.

Diisocyanates suitable as component (i) may be aliphatic, cycloaliphtic or aromatic. Aliphatic diisocyanates preferably have a hydrocarbon radical having 4 to 12 carbon atoms. Suitable diisocyanates are, for example, tetramethylene diisocyanate, hexamethylene diisocyanate (HDI), 2,3,3-trimethylhexamethylene diisocyanate, dodecamethylene diisocyanate, 1,4-cyclohexylene diisocyanate, isophorone diisocyanate (IPDI), dicyclohexylmethane diisocyanate (H12MDI), 2,2-bis(4-isocyanatocyclohexyl)propane, 1,4-phenylene diisocyanate, 2,4- and 2,6-tolylene diisocyanate (TDI) and isomeric mixtures thereof (e.g. 80% 2,4-isomer and 20% 2,6-isomer), 2,4- and 4,4'-diphenylmethane diisocyanate (MDI), o- and m-xylylene diisocyanate (XDI), 1,5-naphthylene diisocyanate, tetramethylxylylene diisocyanate (TMXDI), the isomers of bis(4-isocyanatocyclohexyl)methane, such as, for example, the trans/trans, cis/cis and cis/trans isomers, and mixtures thereof.

The groups in the compounds of component (ii) which are reactive toward isocyanate groups are chosen from hydroxyl groups, primary and secondary amino groups. Depending on these groups, the polymers which result have urethane groups and/or urea groups. Suitable compounds (ii) are, for example, tertiary amines in which the amine nitrogen has two hydroxyalkyl and/or aminoalkyl groups and a further group which is chosen from $C_1$-$C_6$-alkyl, phenyl and phenyl-$C_1$-$C_4$-alkyl.

Component (ii) preferably comprises at least one compound of the formulae

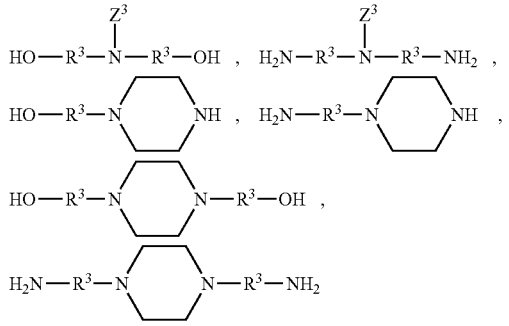

in which $R^3$, independently of one another, are $C_2$-$C_8$-alkanediyl and $Z^3$ is $C_1$-$C_6$-alkyl, phenyl, phenyl-$C_1$-$C_4$-alkyl.

Particularly preferred compounds (ii) are bis(aminopropyl)methylamine, bis(aminopropyl)piperazine, methyldiethanolamine and mixtures thereof.

Suitable compounds (ii) are also polyethers which have at least one tertiary nitrogen atom and two groups reactive toward isocyanate groups, preferably two hydroxyl groups. These are obtainable, for example, by alkoxylation of primary amines, such as, for example, methylamine, in accordance with customary processes known to the person skilled in the art. The number-average molecular weight of the polyethers is preferably in a range from 500 to 6 000 g/mol.

The nitrogen-containing polymers with repeat units of the formula III can, in addition to containing components (i) and (ii), contain further components in incorporated form, as are customary for the preparation of polyurethanes or polyureas. These include, for example, compounds which are different from component (ii) and which have at least two groups reactive toward isocyanate groups, as are customarily used as chain extenders. Preference is given to using no chain extenders.

The nitrogen-containing polymers with repeat units of the formula III can additionally comprise at least one further compound with a group reactive toward isocyanate groups (terminator) in incorporated form. This group is preferably a hydroxyl group or a primary or secondary amino group. Suitable compounds with a group reactive toward isocyanate groups are, for example, monofunctional alcohols, such as methanol, ethanol, n-propanol, isopropanol etc. Also suitable are amines with a primary or secondary amino group, such as, for example, e.g. methylamine, ethylamine, n-propylamine, isopropylamine, dimethylamine, diethylamine, di-n-propylamine, diisopropylamine etc. Also suitable are terminators which have a group reactive toward isocyanate groups and at least one tertiary amino and/or ammonium group. Examples thereof are, for example, N,N-dialkylaminoalcohols or -amines.

Preference is given to polymers which have a number-average molecular weight in the range from about 1 000 to 50000, preferably 2 000 to 20 000.

The content of urethane and/or urea groups is preferably in a range from 2 to 8 mol/kg, particularly preferably 3 to 8 mol/kg, in particular 4 to 8 mol/kg.

Quarternary groups can be generated from the tertiary amine nitrogens in the compounds of component (ii) or in polymers which contain the component (ii) in incorporated form, e.g. either by protonation, e.g. with carboxylic acids, such as lactic acid, or mineral acids, such as phosphoric acid, sulfuric acid and hydrochloric acid, or by quaternization, e.g. with alkylating agents, such as $C_1$-$C_4$-alkyl halides or sulfates, benzyl halides etc. Examples of such alkylating agents are ethyl chloride, ethyl bromide, methyl chloride, methyl bromide, dimethyl sulfate and diethyl sulfate. The neutralization and/or quaternization can be carried out, depending on the intended use, partially, e.g. to 10 to 90%, or completely, i.e. to 100%. The neutralization can be carried out before, during or after the polyaddition.

The polymers with repeat units of the formula III are prepared by reacting at least one diisocyanate (i) with at least one compound of component (ii), and optionally additional compounds with groups reactive toward isocyanate groups. Here, the ratio of NCO equivalent of component (i) to equivalent of active hydrogen atom in component (ii) and optionally additional compounds is generally in a range from about 0.6:1 to 1.4:1, preferably 0.9:1 to 1.1:1, in particular 0.9:1 to 1:1. The reaction can be carried out without solvent or in a suitable inert solvent or solvent mixture. Preference is given to solvents which are miscible with water to an unlimited extent. Preference is also given to solvents which have a boiling point at atmospheric pressure in the range from about 40 to 100° C. Aprotic polar solvents, e.g. tetrahydrofuran, ethyl acetate, N-methylpyrrolidone, dimethylformamide, dimethylacetamide and, preferably, ketones, such as acetone and methyl ethyl ketone, are suitable. If desired, the reaction can be carried out under an inert-gas atmosphere, such as, for example, under nitrogen. In addition, the reaction preferably takes place at ambient pressure or under increased pressure, in particular the intrinsic pressure of the reactants under the reaction conditions. The reaction temperature is preferably in a range from about 5 to 180° C., in particular 20 to 150° C. If compounds which have primary amino groups as groups reactive toward isocyanate groups are predominantly used as component (ii) and optionally as additional components, then the reaction can, if desired, be carried out in a solvent or a solvent mixture which may have active hydrogen atoms. In addition to those mentioned above, preference is then given to using alcohols, such as methanol and ethanol, mixtures of alcohols and water, mixtures of ketones and water, and mixtures of alcohols and the abovementioned ketones.

Suitable polymerization apparatuses are known to the person skilled in the art. These include, for example, stirred reactors, which, if desired, are equipped with devices for dissipating the heat of the reaction. If an organic solvent is used in the preparation of the polymers, then this can be removed subsequently by customary methods known to the person skilled in the art, e.g. by distillation at reduced pressure. Before separating off the solvent, water can additionally be added to the polymer. High-boiling solvents can, if desired, also remain in the solution, although their fraction should preferably be no more than 10% by weight, based on the weight of the polymer.

The cleaner compositions comprise, as component A), at least one surfactant. The surfactants customarily used in cleaners are suitable. The surfactants used may be anionic, nonionic, amphoteric or cationic.

Suitable anionic surfactants are, for example, fatty alcohol sulfates of fatty alcohols having 8 to 22, preferably 8 to 18, carbon atoms, e.g. $C_9$-$C_{11}$-alcohol sulfates, $C_{12}$-$C_{13}$-alcohol sulfates, $C_{14}$-$C_{18}$-alcohol sulfates, such as lauryl sulfate, cetyl sulfate, myristyl sulfate, palmityl sulfate, stearyl sulfate or tallow fatty alcohol sulfate.

Further suitable anionic surfactants are sulfated ethoxylated $C_8$-$C_{22}$-alcohols (alkyl ether sulfates) or soluble salts thereof. Compounds of this type are prepared, for example, by firstly alkoxylating a $C_8$-$C_{22}$-, preferably a $C_{10}$-$C_{18}$-alcohol, e.g. a fatty alcohol, and then sulfating the alkoxylation product. For the alkoxylation, preference is given to using ethylene oxide, where, per mole of fatty alcohol, 2 to 50 mol, preferably 3 to 20 mol, of ethylene oxide are used. The alkoxylation of the alcohols can, however, also be carried out with propylene oxide alone and optionally butylene oxide. Also suitable are those alkoxylated $C_8$-$C_{22}$-alcohols which comprise ethylene oxide and propylene oxide or ethylene oxide and butylene oxide. The alkoxylated $C_8$— to $C_{2-2}$-alcohols can comprise the ethylene oxide, propylene oxide and butylene oxide units in the form of blocks or in random distribution.

Further suitable anionic surfactants are alkanesulfonates, such as $C_8$-$C_{24}$-, preferably $C_{10}$-$C_{18}$—, alkanesulfonates, and soaps, such as, for example, the Na and K salts of $C_8$-$C_{24}$-carboxylic acids.

Further suitable anionic surfactants are $C_8$-$C_{20}$-linear-alkylbenzenesulfonates (LAS), preferably linear $C_9$-$C_{13}$-alkylbenzenesulfonates and -alkyltoluenesulfonates.

Further suitable anionic surfactants are also $C_8$-$C_{24}$-olefinsulfonates and -disulfonates, which can also represent mixtures of alkene- and hydroxyalkanesulfonates or -disulfonates, alkyl ester sulfonates, sulfonated polycarboxylic acids, alkyl glycerol sulfonates, fatty acid glycerol ester sulfonates, alkylphenol polyglycol ether sulfates, paraffinsulfonates having about 20 to 50 carbon atoms (based on paraffin obtained from natural sources or paraffin mixtures), alkyl phosphates, acyl isothionates, acyl taurates, acyl methyltaurates, alkylsuccinic acids, alkenylsuccinic acids or monoesters or monoamides thereof, alkylsulfosuccinic acids or amides thereof, mono- and diesters of sulfosuccinic acids, acyl sarcosinates, sulfated alkyl polyglycosides, alkyl polyglycol carboxylates, and hydroxyalkyl sarcosinates.

Suitable anionic surfactants are also alkyl phosphates.

The anionic surfactants are preferably added to the cleaner in the form of salts. Suitable salts are alkali metal salts, such as sodium, potassium and lithium and ammonium salts, such as e.g. hydroxethylammonium, di(hydroxyethyl)ammonium and tri(hydroxyethyl)ammonium salts.

It is possible to use individual anionic surfactants or a combination of different anionic surfactants. Anionic surfactants from only one class may be used, for example only fatty alcohol sulfates or only alkylbenzenesulfonates, although it is also possible to use surfactant mixtures from different classes, e.g. a mixture of fatty alcohol sulfates and alkylbenzenesulfonates.

Preferred anionic surfactants are alkyl ether sulfates, alkyl sulfates and alkyl phosphates.

Suitable nonionic surfactants are, for example, alkoxylated $C_8$-$C_{22}$-alcohols, such as fatty alcohol alkoxylates or oxo alcohol alkoxylates. The alkoxylation can be carried out with ethylene oxide, propylene oxide and/or butylene oxide. Surfactants which can be used here are all alkoxylated alcohols which contain at least two molecules of an abovementioned alkylene oxide in added form. Block polymers of ethylene oxide, propylene oxide and/or butylene oxide are also suitable here, or addition products which contain said alkylene oxides in random distribution. 2 to 50 mol, preferably 3 to 20 mol, of at least one alkylene oxide is used per mole of alcohol. The alkylene oxide preferably used is ethylene oxide. The alcohols preferably have 10 to 18 carbon atoms.

A further class of suitable nonionic surfactants are alkylphenol ethoxylates with $C_6$-$C_{14}$-alkyl chains and 5 to 30 mol of ethylene oxide units.

A further class of nonionic surfactants are alkyl polyglucosides with 8 to 22, preferably 10 to 18, carbon atoms in the alkyl chain. These compounds mostly contain 1 to 20, preferably 1.1 to 5, glucoside units. Another class of nonionic surfactants are N-alkylglucamides.

Examples of suitable nonionic surfactants are also alkylamine alkoxylates or alkylamide ethoxylates.

The cleaners according to the invention preferably contain $C_{10}$-$C_{16}$-alcohols ethoxylated with 3 to 12 mol of ethylene oxide, particularly preferably ethoxylated fatty alcohols, as nonionic surfactants. Also preferred are alkyl polyglycosides, alkylamine alkoxylates or alkylamide ethoxylates.

It is possible to use individual nonionic surfactants or a combination of different nonionic surfactants, in particular only alkoxylated $C_8$-$C_{22}$-alcohols, but it is also possible to use surfactant mixtures from different classes.

Typical examples of amphoteric surfactants are alkylbetaines, alkylamidobetaines, aminopropionates, aminoglycinates or amphoteric imidazolium compounds. Preferred examples are cocoamphocarboxypropionate, cocoamidocarboxypropionic acid, cocoamphocarboxyglycinate and cocoamphoacetate.

Suitable cationic surfactants are substituted or unsubstituted, straight-chain or branched quaternary ammonium salts, for example $C_8$- to $C_{16}$-dialkyldimethylammonium halides, dialkoxydimethylammonium halides or imidazolinium salts with a long-chain alkyl radical.

The cleaner preparations comprise, as component B), at least one builder. The builders include inorganic builders and organic (co)builders.

Suitable inorganic builder substances are all customary inorganic builders, such as alumosilicates, silicates, carbonates, phosphates and phosphonates.

Suitable inorganic builders are, for example, alumosilicates with ion-exchanging properties, such as, for example, zeolites. Different types of zeolites are suitable, in particular zeolite A, X, B, P, MAP and HS in their Na form or forms in which Na is partially replaced by other cations such as Li, K, Ca, Mg or ammonium. Suitable zeolites are described, for example, in EP-A 0 038 591, EP-A 0 021 491, EP-A 0 087 035, U.S. Pat. No. 4,604,224, GB-A 20 13 259, EP-A 0 522 726, EP-A 0 384 070 and WO-A-94/24 251. Alumosilicate builders are preferred.

Further suitable inorganic builders are, for example, amorphous or crystalline silicates, such as, for example, amorphous disilicates, crystalline disilicates, such as the phyllosilicate SKS-6 (manufacturer Hoechst). The silicates can be used in the form of their alkali metal, alkaline earth metal or ammonium salts. Preference is given to using Na, Li and Mg silicates.

Amorphous silicates, such as, for example, sodium metasilicate, which has a polymeric structure, or amorphous disilicate (Britesil® H 20, manufacturer: Akzo) can likewise be used.

Suitable inorganic builders are also carbonates, including bicarbonates and sesquicarbonates. These can be used in the form of their alkali metal, alkaline earth metal or ammonium salts. Preference is given to using Na, Li and Mg carbonates and hydrogen carbonates, in particular sodium carbonate and/or sodium hydrogen carbonate.

Suitable inorganic builders are also alkali metal, ammonium and alkanolammonium salts of polyphosphates, such as tripolyphosphate, pyrophosphate and glass-like polymeric metaphosphates and phosphonates.

The inorganic builders can be used individually or in mixtures with one another.

Suitable low molecular weight polycarboxylates as organic cobuilders are, for example:

$C_4$-$C_{20}$-Di-, -tri- and -tetracarboxylic acids, such as, for example, succinic acid, propanetricarboxylic acid, butanetetracarboxylic acid, cyclopentanetetracarboxylic acid and alkyl- and alkylenesuccinic acids with $C_2$-$C_{16}$-alkyl or -alkylene radicals;

$C_4$-$C_{20}$-hydroxycarboxylic acids, such as, for example, malic acid, tartaric acid, gluconic acid, glutaric acid, citric acid, lactobionic acid and sucrose mono-, di- and tricarboxylic acid; aminopolycarboxylates, such as, for example, nitrilotriacetic acid, methylglycinediacetic acid, alaninediacetic acid, ethylenediaminetetraacetic acid and serinediacetic acid;

aminopolycarboxylates are commercially available, for example, under the name Trilon®;

Salts of phosphonic acids, such as, for example, hydroxyethanediphosphonic acid, ethylenediaminetetra(methylenephosphonate) and diethylenetriaminepenta(methylenephosphonate).

Suitable oligomeric or polymeric polycarboxylates as organic cobuilders are, for example:

oligomaleic acids, as are described, for example, in EP-A 0 451 508 and EP-A 0 396 303;

co- and terpolymers of unsaturated $C_4$-$C_8$-dicarboxylic acids, the copolymerized comonomers being monoethylenically unsaturated monomers from the group (α) in amounts of up to 95% by weight from the group (β) in amounts of up to 60% by weight from the group (γ) in amounts of up to 20% by weight.

Examples of unsaturated $C_4$-$C_8$-dicarboxylic acids here are maleic acid, fumaric acid, itaconic acid and citraconic acid. Preference is given to maleic acid.

The group (α) comprises monoethylenically unsaturated $C_3$-$C_8$-monocarboxylic acids, such as, for example, acrylic acid, methacrylic acid, crotonic acid and vinylacetic acid. From the group (α), preference is given to using acrylic acid and methacrylic acid.

The group (β) comprises monoethylenically unsaturated $C_2$-$C_{22}$-olefins, vinyl alkyl ethers having $C_1$-$C_8$-alkyl groups, styrene, vinyl esters of $C_1$-$C_8$-carboxylic acids, (meth)acrylamide and vinylpyrrolidone. From the group (β), preference is given to using $C_2$-$C_6$-olefins, vinyl alkyl ethers having $C_1$-$C_4$-alkyl groups, vinyl acetate and vinyl propionate.

The group (γ) comprises (meth)acrylic esters of $C_1$-$C_8$-alcohols, (meth)acrylonitrile, (meth)acrylamides, (meth)acrylamides of $C_1$-$C_8$-amines, N-vinylformamide and vinylimidazole.

If the polymers of group (β) comprise copolymerized vinyl esters, these may also be present in partially or completely hydrolyzed form to give vinyl alcohol structural units. Suitable co- and terpolymers are known, for example, from U.S. Pat. No. 3,887,806 and DE-A 43 13 909.

Suitable copolymers of dicarboxylic acid as organic cobuilders are preferably:

copolymers of maleic acid and acrylic acid in the weight ratio 10:90 to 95:5, particularly preferably those in the weight ratio 30:70 to 90:10 with molar masses from 10 000 to 150 000;

terpolymers of maleic acid, acrylic acid and a vinyl ester of a $C_1$-$C_3$-carboxylic acid in the weight ratio 10 (maleic acid): 90 (acrylic acid+vinyl ester) to 95 (maleic acid): 10 (acrylic acid+vinyl ester), where the weight ratio of acrylic acid to vinyl ester can vary in the range from 20:80 to 80:20, and particularly preferably terpolymers of maleic acid, acrylic acid and vinyl acetate or vinyl propionate in the weight ratio 20 (maleic acid): 80

(acrylic acid+vinyl ester) to 90 (maleic acid): 10 (acrylic acid+vinyl ester), where the weight ratio of acrylic acid to the vinyl ester can vary in the range from 30:70 to 70:30;

copolymers of maleic acid with $C_2$-$C_8$-olefins in the molar ratio 40:60 to 80:20, where copolymers of maleic acid with ethylene, propylene or isobutene in the molar ratio 50:50 are particularly preferred.

Graft polymers of unsaturated carboxylic acids on low molecular weight carbohydrates or hydrogenated carbohydrates, cf.

U.S. Pat. No. 5,227,446, DE-A 44 15 623, DE-A 43 13 909, are likewise suitable as organic cobuilders.

Suitable unsaturated carboxylic acids are here, for example, maleic acid, fumaric acid, itaconic acid, citraconic acid, acrylic acid, methacrylic acid, crotonic acid and vinylacetic acid, and mixtures of acrylic acid and maleic acid which are grafted in amounts of from 40 to 95% by weight, based on the component to be grafted.

For the modification, up to 30% by weight, based on the component to be grafted, of further monoethylenically unsaturated monomers can additionally be present in copolymerized form. Suitable modifying monomers are the abovementioned monomers of groups (β) and (γ).

Suitable graft bases are degraded polysaccharides, such as, for example, acidic or enzymatically degraded starches, inulins or cellulose, reduced (hydrogenated or reductively aminated) degraded polysaccharides, such as, for example, mannitol, sorbitol, aminosorbitol and glucamine, and also polyalkyleneglycols with molar masses up to $M_w$=5 000, such as, for example, polyethylene glycols, ethylene oxide/propylene oxide or ethylene oxide/butylene oxide block copolymers, random ethylene oxide/propylene oxide or ethylene oxide/butylene oxide copolymers, alkoxylated mono- or polyhydric $C_1$-$C_{22}$-alcohols, cf. U.S. Pat. No. 4,746,456.

From this group, preference is given to using grafted degraded or 40 degraded reduced starches and grafted polyethylene oxides, where 20 to 80% by weight of monomers are used based on the graft component in the graft polymerization. For the grafting, preference is given to using a mixture of maleic acid and acrylic acid in the weight ratio of 90:10 to 10:90.

Polyglyoxylic acids as organic cobuilders are described, for example, in EP-B 0 001 004, U.S. Pat. No. 5,399,286, DE-A 41 06 355 and EP-A 0 656 914. The end groups of the polyglyoxylic acids can have different structures.

Polyamidocarboxylic acids and modified polyamidocarboxylic acids as organic cobuilders are known, for example, from EP-A 0 454 126, EP-B 0 511 037, WO-A 94/01486 and EP-A 0 581 452.

As organic cobuilders, preference is also given to using polyaspartic acid or cocondensates of aspartic acid with further amino acids, $C_4$-$C_{25}$-mono- or -dicarboxylic acids and/or $C_4$-$C_{25}$-mono- or -diamines. Particular preference is given to using polyaspartic acids prepared in phosphorus-containing acids and modified with $C_6$-$C_{22}$-mono- or -dicarboxylic acids or with $C_6$-$C_{22}$-mono- or -diamines.

Condensation products of citric acid with hydroxycarboxylic acids or polyhydroxy compounds as organic cobuilders are known, for example, from WO-A 93/22362 and WO-A 92/16493. Such carboxyl-containing condensates usually have molar masses up to 10 000, preferably up to 5 000.

The cleaner formulations may be in powder form, granule form, paste form, gel form or liquid.

In a preferred embodiment, the cleaner composition according to the invention comprises customary ingredients which are chosen from soil release polymers, enzymes, foam boosters, foam suppressors or foam inhibitors, biocides, bleaching systems, antitarnish agents and/or corrosion inhibitors, suspending agents, dyes, fillers, inorganic extenders, disinfectants, pH-regulating substances, hydrotropic compounds, antioxidants, enzyme stabilizers, perfumes, solvents, solubility promoters, dispersants, processing auxiliaries, solubilizers, softeners and antistats.

Suitable soil release polymers for cleaner compositions are, for example:

polyesters of polyethylene oxides with ethylene glycol and/or propylene glycol and aromatic dicarboxylic acids or aromatic and aliphatic dicarboxylic acids;

polyesters of polyethylene oxides, terminally capped on one end, with di- and/or polyhydric alcohols and dicarboxylic acid.

Such polyesters are known, for example, from U.S. Pat. No. 3,557,039, GB-A 11 54 730, EP-A 0 185 427, EP-A 0 241 984, EP-A 0 241 985, EP-A 0 272 033 and U.S. Pat. No. 5,142,020.

Further suitable soil release polymers are amphiphilic graft polymers or copolymers of vinyl and/or acrylic esters on polyalkylene oxides (cf. U.S. Pat. No. 4,746,456, U.S. Pat. No. 4,846,995, DE-A 37 11299, U.S. Pat. No. 4,904,408, U.S. Pat. No. 4,846,994 and U.S. Pat. No. 4,849,126) or modified celluloses, such as, for example, methylcellulose, hydroxypropylcellulose or carboxymethylcellulose.

Suitable enzymes are proteases, lipases, amylases and cellulases. The enzyme system can be limited to a single enzyme or include a combination of different enzymes.

Suitable foam suppressors or foam inhibitors are, for example, organopolysiloxanes and mixtures thereof with microfine, optionally silanized silica, and paraffins, waxes, microcrystalline waxes and mixtures thereof with silanized silica.

Suitable biocides are, for example, isothiazolinones, 2-bromo-2-nitro-1,3-propanediol.

Suitable bleaching systems consist, for example, of bleaching agents and bleach activators.

Bleaches are divided into oxygen bleaches and chlorine-containing bleaches. Oxygen bleaches used are alkali metal perborates and hydrates thereof, and also alkali metal percarbonates. Preferred bleaches here are sodium perborate in the form of the mono- or tetrahydrate, sodium percarbonate or the hydrates of sodium percarbonate. Oxygen bleaches which can likewise be used are persulfates and hydrogen peroxide. Typical oxygen bleaches are also organic peracids, such as, for example, perbenzoic acid, peroxy-alpha-naphthoic acid, peroxylauric acid, peroxystearic acid, phthalimidoperoxycaproic acid, 1,12-diperoxydodecanedioic acid, 1,9-diperoxyazelaic acid, diperoxoisophthalic acid or 2-decyldiperoxybutane-1,4-dioic acid.

In addition, the following oxygen bleaches can also be used in the cleaner composition: cationic peroxy acids which are described in the patent applications U.S. Pat. No. 5,422,028, U.S. Pat. No. 5,294,362 and U.S. Pat. No. 5,292,447; sulfonylperoxy acids which are described in patent application U.S. Pat. No. 5,039,447.

Oxygen bleaches are used in amounts of from 0.5 to 30% by weight, preferably from 1 to 20% by weight, particularly preferably from 3 to 15% by weight, based on the overall cleaner composition.

Chlorine-containing bleaches and the combination of chlorine-containing bleaches with peroxide-containing bleaches can likewise be used. Known chlorine-containing bleaches are, for example, 1,3-dichloro-5,5-dimethylhydantoin, N-chlorosulfamide, chloramine T, dichloramine T, chloramine B, N,N'-dichlorobenzoylurea, p-toluenesulfondichloroamide or trichloroethylamine. Preferred chlorine-containing bleaches are sodium hypochlorite, calcium hypochlorite, potassium hypochlorite, magnesium hypochlorite, potassium dichloroisocyanurate or sodium dichloroisocyanurate.

Chlorine-containing bleaches are used in amounts of from 0.1 to 20% by weight, preferably from 0.1 to 10% by weight, particularly preferably from 0.3 to 8% by weight, based on the overall cleaner composition.

In addition, bleach stabilizers, such as, for example, phosphonates, borates, metaborates, metasilicates or magnesium salts, can be added in small amounts.

Bleach activators are compounds which, under perhydrolysis conditions, produce aliphatic peroxocarboxylic acids having, preferably, 1 to 10 carbon atoms, in particular 2 to 4 carbon atoms, and/or substituted perbenzoic acid. Compounds which contain one or more N- or O-acyl groups and/or optionally substituted benzoyl groups are suitable, for example substances from the class of anhydrides, esters, imides, acylated imidazoles or oximes. Examples are tetracetylethylenediamine (TAED), tetraacetylmethylenediamine (TAMD), tetraacetylglycoluril (TAGU), tetraacetylhexylenediamine (TAHD), N-acylimides, such as, for example, N-nonanoylsuccinimide (NOSI), acylated phenolsulfonates, such as, for example, n-nonanoyl- or isononanoyloxybenzene sulfonates (n- or iso-NOBS), pentaacetylglucose (PAG), 1,5-diacetyl-2,2-dioxohexahydro-1,3,5-triazine (DADHT) or isatoic anhydride (ISA).

Other suitable bleach activators are nitrile quats, such as, for example, N-methylmorpholinium acetonitrile salts (MMA salts) or trimethylammonium acetonitrile salts (TMAQ salts).

Preferably suitable are bleach activators from the group consisting of polyacylated alkylenediamines, particularly preferably TAED, N-acylimides, particularly preferably NOSI, acylated phenolsulfonates, particularly preferably n- or iso-NOBS, MMA and TMAQ. In addition, the following substances can be used as bleach activators in the cleaner composition: carboxylic anhydrides, such as, for example, phthalic anhydride; acylated polyhydric alcohols, such as, for example, triacetin, ethylene glycol diacetate or 2,5-diacetoxy-2,5-dihydrofuran; the enol esters known from DE-A 196 16 693 and DE-A 196 16 767, and acetylated sorbitol and mannitol or mixtures thereof described in EP-A 525 239; acylated sugar derivatives, in particular pentaacetylglucose (PAG), pentaacetylfructose, tetraacetylxylose and octaacetyllactose, and acetylated, optionally N-alkylated, glucamine and gluconolactone, and/or N-acylated lactams, for example N-benzoylcaprolactam, which are known from the specifications WO 94/27 970, WO 94/28 102, WO 94/28 103, WO 95/00 626, WO 95/14 759 and WO 95/17 498; the hydrophilically substituted acylacetals listed in DE-A 196 16 769, and the acyllactams described in DE-A 196 16 770 and WO 95/14 075 can likewise be used, as can the combinations of conventional bleach activators known from DE-A 44 43 177.

Bleach activators are used in amounts of from 0.1 to 10% by weight, preferably from 1 to 8% by weight, particularly preferably from 1.5 to 6% by weight, based on the overall cleaner formulation.

In addition to the conventional bleach activators listed above, or instead of them, it is also possible for the sulfonimines known from EP-A 446 982 and EP-A 453 003 and/or bleach-boosting transition metal salts or transition metal complexes to be present as bleaching catalysts in the cleaner compositions.

Suitable transition metal compounds include, for example, the manganese-, iron, cobalt-, ruthenium- or molybdenum-salen complexes known from DE-A 195 29 905, and their N-analogous compounds known from DE-A 196 20 267, the manganese-, iron-, cobalt-, ruthenium- or molybdenum-carbonyl complexes known from DE-A 195 36 082, the manganese, iron, cobalt, ruthenium, molybdenum, titanium, vanadium and copper complexes with nitrogen-containing tripod ligands described in DE-A 196 05 688, the cobalt-, iron-, copper- and ruthenium-amine complexes known from DE-A 196 20 411, the manganese, copper and cobalt complexes described in DE-A 44 16 438, the cobalt complexes described in EP-A 272 030, the manganese complexes known from EPA 693 550, the manganese, iron, cobalt and copper complexes known from EP-A 392 592 and/or the manganese complexes described in EP-A 443 651, EP-A 458 397, EP-A 458 398, EP-A 549 271, EP-A 549 272, EP-A 544 490 and EP-A 544 519. Combinations of bleach activators and transition metal bleaching catalysts are known, for example, from DE-A 196 13 103 and WO 95/27 775.

Bleach-boosting transition metal complexes or salts from the group consisting of the manganese salts and complexes and the cobalt salts and complexes are preferably suitable. Particularly preferably suitable are the cobalt (amine) complexes, the cobalt (acetate) complexes, the cobalt (carbonyl) complexes, the chlorides of cobalt or manganese and manganese sulfate.

Bleaching catalysts are used in amounts of from 0.0001 to 5% by weight, preferably from 0.0025 to 1% by weight, particularly preferably from 0.01 to 0.25% by weight, based on the overall cleaner composition.

Suitable corrosion inhibitors which can be used are, for example, silver protectants from the group of triazoles, benzotriazoles, bisbenzotriazoles, aminotriazoles, alkylaminotriazoles and transition metal salts or complexes.

A suitable inorganic extender is, for example, sodium sulfate.

Suitable pH-regulating substances are, for example, alkalis, such as NaOH, KOH, pentasodium metasilicate or acids, such as hydrochloric acid, phosphoric acid, amidosulfuric acid, citric acid.

Suitable solvents are, for example, short-chain alkyl oligoglycols, such as butyl glycol, butyl diglycol, propylene glycol monomethyl ether, hexyl glycols, alcohols, such as ethanol or isopropanol, aromatic solvents, such as toluene, xylene, N-alkylpyrrolidones, alkylene carbonates.

Suitable dispersants are, for example, naphthalenesulfonic acid condensates, polycarboxylates.

Suitable solubilizers are, for example, cumenesulfonates, toluenesulfonates, short-chain fatty acids, phosphoric alkyl/aryl esters, hexyl glycols.

Examples of suitable cleaner compositions according to the invention are machine cleaners, metal degreasers, glass cleaners, floor cleaners, all-purpose cleaners, high-pressure cleaners, alkaline cleaners, acidic cleaners, spray degreasers, dairy cleaners, rinse aids, dishwashing detergents etc.

A solid cleaner composition according to the invention is usually in pulverulent or granular form or in extrudate or tablet form.

Pulverulent or granular cleaner compositions according to the invention can comprise up to 60% by weight of inorganic extenders. Sodium sulfate is customarily used for this purpose. The cleaner compositions according to the invention, however, preferably have a low content of extenders and comprise only up to 20% by weight, particularly preferably up to 8% by weight, of extenders, in particular in the case of compact or ultracompact cleaner compositions. The solid cleaner compositions according to the invention can have varying bulk densities in the range from 300 to 1 300 g/l, in particular from 550 to 1 200 g/l. Modern compact cleaners generally have high bulk densities and have a granular structure. To achieve the desired compaction of the cleaner compositions, it is possible to use the processes customary in the art.

Cleaner compositions according to the invention which are in tablet form usually further comprise tabletting auxiliaries, such as polyethylene glycols with molar masses greater than 1 000 g/mol, polymer dispersions and tablet disintegrants, such as cellulose derivatives, crosslinked polyvinylpyrrolidone, crosslinked polyacrylates or combinations of acids, such as citric acid and sodium bicarbonate.

The cleaner composition according to the invention is prepared by customary methods and optionally formulated.

The present invention further provides a method of cleaning hard surfaces in which the hard surface is brought into contact with an aqueous solution of a cleaner composition which comprises a) at least one surfactant and b) at least one nitrogen-containing polymer with repeat units of the formula I, II or III, (I)

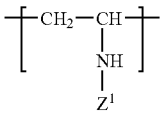

(II)

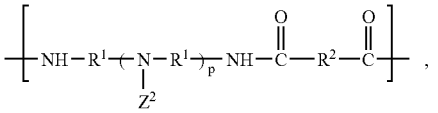

(III)

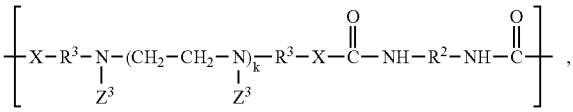

or reaction products thereof with neutralizing agents or quaternizing agents, in which the variables $R^1$, $R^2$, $R^3$, $Z^1$, $Z^2$, $Z^3$, k and p have the meanings given above, and optionally at least one builder, and removing and/or rinsing off the excess.

The term "hard surface" is usually understood as meaning surfaces of objects made of plastic, glass, stainless steel, enamel or surfaces of tiles and painted surfaces. As a rule, the hard surface is treated with a dilute, preferably aqueous, solution of the cleaner composition in a manner typical for the type of surface, e.g. by washing, spraying, wiping or similar methods, as are customarily used for the cleaning of objects with hard surfaces. The washing can take place, for example, in a machine or by hand. The "bringing into contact" usually takes place during the cleaning operation. The amount of nitrogen-containing polymer with repeat units of the formula I, II or III necessary for the hydrophilization is adsorbed by the surface and adheres as a thin film to the surface. The amount necessary to achieve hydrophilization is established automatically and remains adhering after drying. An excess can, for example, be rinsed off with water, or be wiped away using a structure made of an absorbent material, for example a cloth.

The cleaner compositions according to the invention are used, for example, for cleaning work surfaces, tiles, bathroom fitments, kitchen furniture such as tables, chairs, cupboards, kitchen appliances, such as fridge, cooker or extractor hood, furniture made of plastic, crockery, glasses, windows or venetian blinds.

The nitrogen-containing polymers with repeat units of the formula I, II or III used in the cleaner compositions have a cleaning-enhancing action. The cleaner composition according to the invention noticeably facilitates the removal of soiling. Particularly in the case of regular application, the adhesion of soiling is permanently reduced.

Performance examples show that, using the nitrogen-containing polymers with repeat units of the formula I, II or III used according to the invention in the cleaner compositions, it is possible to effectively hydrophilize hard surfaces.

The examples below serve to illustrate the invention without limiting it.

I. PREPARATION EXAMPLES

Example 1

Butoxylated polyvinylamine (q=2)

496.6 g of an aqueous polyvinylamine solution (K value=45; polymer content=8.3% by weight; number of amino groups per 100 g of solution=182.1 mmol/100 g; amino groups in the mixture n=0.904 mol) and 1 300 g of xylene were introduced into a 5 l metal reactor and then rendered inert three times using 5 bar of nitrogen in each case. The reactor contents were heated to 90° C., and then 130.2 g of butylene oxide were metered in over a period of 120 minutes until a pressure of 5 bar had been reached. The mixture was then after-stirred until the pressure was constant. After cooling and decompressing the reactor, a butoxylated polyvinylamine mixture with an average degree of butoxylation q of 2 was obtained.

Example 2

Propoxylated polyaminoamide (about 50% of the Aminic Nitrogens Converted)

2982 g of a 57% strength aqueous polyaminoamide solution (adipic acid-diethylenetriamine 1:1 condensate, amino groups in the mixture n=8.02 mol) were introduced at 70° C. into a 5 l metal reactor and then rendered inert three times using 5 bar of nitrogen in each case. The reactor contents were heated to 80° C., and then 233 g (4.01 mol) of propene oxide were metered in until a pressure of 5 bar had been reached. The mixture was then after-stirred until the pressure was constant. Following cooling and decompression of the reactor and removal of gases on a rotary evaporator at 50° C. and 500 mbar, a propoxylated polyaminoamide was obtained in which every second amine was modified.

Example 3

Polyaminoamide modified with hexanoic acid 103.3 g of diethylenetriamine were introduced into a 1 l stirred apparatus and heated to 120° C. under nitrogen. When this temperature was reached, 116.2 g of hexanoic acid were added dropwise and then the mixture was heated to 170° C. Water of reaction which formed distilled off. After an acid number of about 10 mmol of KOH/g was reached, the mixture was left to cool to 140° C., and 146.2 g of adipic acid were introduced. Following renewed heating to 170° C., water of reaction was distilled off until an acid number of 21.2 mg of KOH/g and an amine number of 0.61 mmol of N/g were reached. After cooling, a 40% strength solution of the polyaminoamide modified with hexanoic acid was prepared by adding deionized water.

Example 4

Polyurea from isophorone diisocyanate and bis(aminopropyl)piperazine 20.0 g (0.1 mol) of bis(aminopropyl)piperazine were dissolved in 200 g of acetone in a four-necked flask fitted with stirrer, dropping funnel, thermometer and reflux condenser. 22.2 g (0.1 mol) of isophorone diisocyanate were added dropwise thereto at a rate such that the temperature did not exceed 30° C. The reaction mixture was stirred at reflux for a further hour and then 110 g of HCl (1 n) and 100 g of water were added. The acetone was then distilled off under reduced pressure. This gave a polyurea solution with a solids content of 16.7% by weight and a pH of 7.2. The ammonium content of the polymer was 2.61 mol/kg. The urea content of the polymer was 4.74 mol/kg.

Example 5

Polyurea from isophorone diisocyanate and bis(aminopropyl)methylamine

A polyurea was prepared from 14.5 g (0.1 mol) of bis(aminopropyl)methylamine and 22.2 g (0.1 mol) of isophorone diisocyanate analogously to the preparation procedure for polyurea 1. This gave a polyurea solution with a solids content of 25.5% by weight and a pH following acidification with lactic acid of 7.7. The ammonium content of the polymer was 2.72 mol/kg. The urea content of the polymer was 5.45 mol/kg.

Example 6

Polyurethane from isophorone diisocyanate and methyldiethanolamine 11.92 g (0.1 mol) of methyldiethanolamine were dissolved in 200 g of acetone in a four-necked flask fitted with stirrer, dropping funnel, thermometer and reflux condenser. 22.2 g (0.1 mol) of isophorone diisocyanate were added dropwise thereto at a rate such that the temperature did not exceed 30° C. The reaction mixture was stirred at reflux for a further 8 hours. 100 g of HCl (1 n) were then added, and the acetone was distilled off under reduced pressure. This gave a polyurethane solution with a solids content of 29.7% by weight and a pH of 7.2. The ammonium content of the polymer was 2.93 mol/kg. The urethane content of the polymer was 5.86 mol/kg.

Example 7

Polyurea from isophorone diisocyanate and bis(aminopropyl)methylamine 174 g (1.2 mol) of bis(aminopropyl)methylamine were dissolved in 1 200 g of acetone in a four-necked flask fitted with stirrer, dropping funnel, thermometer and reflux condenser, and neutralized with 1140 g of HCl (1 n). 266.4 g (1.2 mol) of isophorone diisocyanate were added dropwise to this reaction mixture over the course of 20 minutes. The reaction mixture was stirred at reflux for a further hour and then the acetone was distilled off under reduced pressure. This gave a polyurea solution with a solids content of 36.3% by weight and a pH of 7.3. The ammonium content of the polymer was 2.59 mol/kg. The urea content of the polymer was 5.45 mol/kg.

Example 8

Polyurea from hexamethylene diisocyanate and bis(aminopropyl)methylamine

A polyurea was prepared analogously to polyurea 4 from 7.25 g (0.05 mol) of bis(aminopropyl)methylamine and 8.41 g (0.05 mol) of hexamethylene diisocyanate. This gave a polyurea solution with a solids content of 40.3% by weight and a pH of 7.4. The ammonium content of the polymer was 3.19 mol/kg. The urea content of the polymer was 6.39 mol/kg.

Example 9

Polyurea from isophorone diisocyanate and bis(aminopropyl)methylamine 29.0 g (0.2 mol) of bis(aminopropyl)methylamine were dissolved in a mixture of 180 g of water, 200 g of acetone and 20 g of 90% strength lactic acid in a four-necked flask fitted with stirrer, dropping funnel, thermometer and reflux condenser. 44.4 g (0.2 mol) of isophorone diisocyanate were added dropwise thereto over a period of 20 minutes. The reaction mixture was stirred at reflux for a further hour and then the acetone was distilled off under reduced pressure. This gave a polyurea solution with a solids content of 36.4% by weight. The ammonium content of the polymer was 2.72 mol/kg. The urea content of the polymer was 5.45 mol/kg.

II. APPLICATION EXAMPLES

The following compositions were prepared:

| | | |
|---|---|---|
| | | Cleaner composition 1 (comparison) |
| 11% | by weight | of $C_{12}$-$C_{18}$-fatty alcohol ethoxylate (Lutensol A7N) |
| 3% | by weight | of $C_{12}$-$C_{18}$-fatty alcohol ethoxylate (Lutensol A4N) |
| 6% | by weight | of a combination of anionic/nonionic surfactants (Lutensit A-LBN 50) |
| ad 100% | by weight | with water |
| | | Cleaner composition 2 |
| 11% | by weight | of Lutensol A7N |
| 3% | by weight | of Lutensol A4N |
| 6% | by weight | of Lutensit A-LBN 50 |
| 3% | by weight | of propoxylated polyaminoamide from example 2 |
| ad 100% | by weight | with water |
| | | Cleaner composition 3 |
| 11% | by weight | of Lutensol A7N |
| 3% | by weight | of Lutensol A4N |
| 6% | by weight | of Lutensit A-LBN 50 |
| 3% | by weight | of polyaminoamide modified with hexanoic acid from example 3 |
| ad 100% | by weight | with water |
| | | Cleaner composition 4 |
| 11% | by weight | of Lutensol A7N |
| 3% | by weight | of Lutensol A4N |

-continued

| | |
|---|---|
| 6% by weight | of Lutensit A-LBN 50 |
| 3% by weight | of polyurea from isophorone diisocyanate and bis(aminopropyl)methylamine from example 5 |
| ad 100% by weight | with water |

The cleaner compositions were adjusted to pH=9 with acetic acid or sodium hydroxide solution. The cleaner compositions described above were then diluted with water so that the ready-to-use solution had an active content of about 1%.

The release capacity of colored mineral oil from test bodies made of polyethylene (size: 1.5×8 cm) was investigated.

PE test bodies were pretreated as stated in the table below. The pretreated test bodies were each then coated with 0.1 g of mineral oil. To determine the oil release capacity, the test bodies were dipped into one of the above diluted cleaner compositions. The test bodies were weighed down with a lattice rack in order to prevent emergence. The immersion time was 8 min in each case. Following removal, the test bodies were dried for at least 3 hours at 50° C. The weight of the test bodies was determined, and the proportion of mineral oil which was left behind was calculated in %. The results are given in the tables below. The measurements were carried out in each case as a double determination. The average of two measurements has been given in each case.

TABLE 1

Cleaning with cleaner composition 1 (comparison)

| Pretreatment with | Remaining oil in % |
|---|---|
| Cleaner composition 1 | 33.3 |
| Cleaner composition 1, then rinsed off | 18.0 |
| untreated | 16.3 |

TABLE 2

Cleaning with cleaner composition 2

| Pretreatment with | Remaining oil in % |
|---|---|
| Cleaner composition 2 | 1.1 |
| Cleaner composition 2, then rinsed off | 1.4 |
| untreated | 25.0 |

TABLE 3

Cleaning with cleaner composition 3

| Pretreatment with | Remaining oil in % |
|---|---|
| Cleaner composition 3, | 2.0 |
| Cleaner composition 3, then rinsed off | 4.3 |
| untreated | 22.1 |

TABLE 4

Cleaning with cleaner composition 4

| Pretreatment with | Remaining oil in % |
|---|---|
| Cleaner composition 4 | 7.1 |
| Cleaner composition 4, then rinsed off | 4.7 |
| untreated | 33.4 |

The results show that the use of the cleaner compositions 2, 3 or 4 leads to a significantly lower soiling tendency of the test bodies. The results also show that the composition used for the pretreatment has a great influence on the soiling behavior of the test bodies and can even hinder subsequent cleaning.

We claim:

1. A cleaner composition comprising

A) at least one surfactant,

B) at least one builder and

C) at least one nitrogen-containing polymer with repeat units of the formula III, (III)

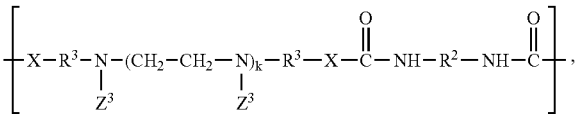

wherein $R^2$ is a chemical bond or $C_1$-$C_{20}$-alkanediyl which is optionally interrupted by a double bond and/or an imino group and/or is optionally, completely or partially, a constituent of one or more saturated or unsaturated carbocyclic 5- to 8-membered rings, where the alkanediyl may carry one or more hydroxyl groups and/or amino groups, $R^3$ is $C_2$-$C_8$-alkanediyl or is $$—CH_2—CHR^4-(O—CH_2—CHR^4)_q—$$

X is O, NH or $C_1$-$C_6$-alkylamino, $Z^3$ is $C_1$-$C_6$-alkyl, phenyl or phenyl-$C_1$-$C_4$-alkyl, if k=0, together with N—$R^3$—X can form a 5- to 7-membered saturated heterocyclic ring having 2 nitrogen atoms or, if k=1, the two radicals $Z^3$ can together with N—$CH_2$—$CH_2$—N form a 5- to 7-membered saturated heterocyclic ring having 2 nitrogen atoms, $R^4$ is hydrogen or $C_1$-$C_{10}$-alkyl, q is a number from 1 to 20, k is 0 or 1;

or reaction products thereof with neutralizing agents or quaternizing agents.

2. The cleaner composition comprising:

A) at least one surfactant,

B) at least one builder and

C) at least one nitrogen-containing polymer with repeat units of the formula III, wherein $R^2$ is $C_2$-$C_{12}$-alkanediyl,

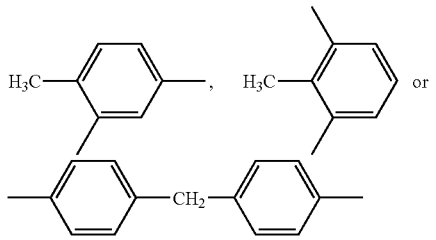

$R^3$ is $C_2$-$C_8$-alkanediyl or is $$—CH_2—CHR^4\text{-}(O—CH_2—CHR^4)_q—$$

X is O, NH or $C_1$-$C_6$-alkylamino, $Z^3$ is $C_1$-$C_6$-alkyl, phenyl or phenyl-$C_1$-$C_4$-alkyl, if k=0, together with N—$R^3$—X can form a 5- to 7-membered saturated heterocyclic ring having 2 nitrogen atoms or, if k=1, the two radicals $Z^3$ can together with N—$CH_2$—$CH_2$—N form a 5- to 7-membered saturated heterocyclic ring having 2 nitrogen atoms, $R^4$ is hydrogen or $C_1$-$C_{10}$-alkyl, q is a number from 1 to 20, k is 0 or 1;

or reaction products thereof with neutralizing agents or quaternizing agents.

3. The cleaner composition as claimed claim 1, comprising (A) 0.5 to 40% by weight of surfactant, (B) 1 to 60% by weight of builder, (C) 0.01 to 50% by weight of nitrogen-containing polymer, based on the total weight of the cleaner composition.

4. The cleaner composition as claimed in claim 1, wherein the builder is selected from the group consisting of polyphosphates, phosphonates, silicates, carbonates, aluminosilicates, polycarboxyl compounds and complexing agents.

5. A method of cleaning hard surfaces, comprising contacting a hard surface with an aqueous solution of a cleaner composition as claimed in claim 1.

6. The cleaner composition as claimed claim 2, comprising (A) 0.5 to 40% by weight of surfactant, (B) 1 to 60% by weight of builder, (C) 0.01 to 50% by weight of nitrogen-containing polymer, based on the total weight of the cleaner composition.

7. The cleaner composition as claimed in claim 2, wherein the builder is selected from the group consisting of polyphosphates, phosphonates, silicates, carbonates, aluminosilicates, polycarboxyl compounds and complexing agents.

8. A method of cleaning hard surfaces, comprising contacting a hard surface with an aqueous solution of a cleaner composition as claimed in claim 2.

9. A cleaner composition comprising

A) at least one surfactant,

B) at least one builder and

C) at least one nitrogen-containing polymer with repeat units of the formula III, (III)

$$\left[X-R^3-\underset{\underset{Z^3}{|}}{N}-(CH_2-CH_2-\underset{\underset{Z^3}{|}}{N})_k-R^3-X-\overset{\overset{O}{\|}}{C}-NH-R^2-NH-\overset{\overset{O}{\|}}{C}\right],$$

wherein $R^2$ is a chemical bond or $C_1$-$C_{20}$-alkanediyl which is optionally interrupted by a double bond and/or an imino group and/or is optionally, completely or partially, a constituent of one or more saturated or unsaturated carbocyclic 5- to 8-membered rings, where the alkanediyl may carry one or more hydroxyl groups and/or amino groups, $R^3$ is $C_2$-$C_8$-alkanediyl or is $$—CH_2—CHR^4\text{-}(O—CH_2—CHR^4)_q—$$

X is NH or $C_1$-$C_6$-alkylamino, $Z^3$ is $C_1$-$C_6$-alkyl, phenyl or phenyl-$C_1$-$C_4$-alkyl, if k=0, together with N—$R^3$—X can form a 5- to 7-membered saturated heterocyclic ring having 2 nitrogen atoms or, if k=1, the two radicals $Z^3$ can together with N—$CH_2$—$CH_2$—N form a 5- to 7-membered saturated heterocyclic ring having 2 nitrogen atoms, $R^4$ is hydrogen or $C_1$-$C_{10}$-alkyl, q is a number from 1 to 20, k is 0 or 1;

or reaction products thereof with neutralizing agents or quaternizing agents.

10. The cleaner composition according to claim 9, comprising:

(A) 0.5 to 40% by weight of surfactant, (B) 1 to 60% by weight of builder, (C) 0.01 to 50% by weight of nitrogen-containing polymer, based on the total weight of the cleaner composition.

11. The cleaner composition as claimed in claim 9, wherein the builder is selected from the group consisting of polyphosphates, phosphonates, silicates, carbonates, aluminosilicates, polycarboxyl compounds and complexing agents.

12. A method of cleaning hard surfaces, comprising contacting a hard surface with an aqueous solution of a cleaner composition as claimed in claim 9.

* * * * *